US006889454B2

(12) United States Patent
Chandaria

(10) Patent No.: US 6,889,454 B2
(45) Date of Patent: May 10, 2005

(54) DISPLAY CARD FOR MERCHANDISING STRIPS AND METHOD OF MANUFACTURING SAME

(76) Inventor: Ashok V. Chandaria, P.O. Box 48870, Nairobi (KE)

( * ) Notice: Subject to any disclaimer, the term of this patent is extended or adjusted under 35 U.S.C. 154(b) by 164 days.

(21) Appl. No.: 10/232,237

(22) Filed: Aug. 29, 2002

(65) Prior Publication Data

US 2004/0040189 A1 Mar. 4, 2004

(51) Int. Cl.[7] ..... G09F 1/00

(52) U.S. Cl. ..... 40/124.01; 40/124.06; 40/642.01; 211/85.26

(58) Field of Search ..... 40/124.01, 124.06, 40/661.09, 642.01, 594; 206/806; 211/71.01, 85.26; 248/317; 260/806

(56) References Cited

U.S. PATENT DOCUMENTS 791,912 A * 6/1905 Jackson ..... 206/459.5
4,016,665 A * 4/1977 Sakota ..... 40/582
4,817,805 A * 4/1989 Rodriquez ..... 211/85.15
5,240,109 A * 8/1993 Weder et al. ..... 206/423
6,109,582 A * 8/2000 Repaci et al. ..... 248/317

* cited by examiner

*Primary Examiner*—Gary C. Hoge
(74) *Attorney, Agent, or Firm*—Sand & Sebolt

(57) ABSTRACT

A merchandising display card and method of production of the same is disclosed. The display card is adapted to be hung from store displays or shelves in such a manner that product is displayed for the consumer without taking up valuable shelf space. The card includes a means for releasably securing products to it. The means is preferably an adhesive applied to the sheet either at discrete points or over the entire surface. Products may be applied directly to the sheet, may be removed therefrom for inspection by the consumer and if no purchase is made, the product may be reattached to the sheet with relative ease.

20 Claims, 10 Drawing Sheets

DISPLAY CARD FOR MERCHANDISING STRIPS AND METHOD OF MANUFACTURING SAME

BACKGROUND OF THE INVENTION

1. Technical Field

This invention generally relates to a display card for merchandise and to a method for manufacturing the same. More particularly, the invention relates to a display card for merchandise that includes a means for releasably securing merchandise to it, so that the card may be shipped and displayed without the merchandise becoming accidentally dislodged from it. Specifically, the invention relates to a display card that includes a plurality of adhesive strips for releasably securing the merchandise to the card.

2. Background Information

Retailers frequently use clip strips or clip sheets for displaying products that are too small to place on shelves or products that are seasonal in nature. These clip strips or sheets are positioned in strategic locations around the store to entice consumers to buy the merchandise displayed on the strips. The strips or sheets are hung on other product displays or on shelf supports so that they do not take up valuable shelf space.

The clip strips and sheets used in the prior art are typically manufactured from a lightweight plastic that has been die-cut to produce a plurality of upwardly extending pegs that are each flanked by two downwardly extending legs. The products for display need to be mounted onto a cardboard backing sheet that includes an hole toward its upper end. The peg of the clip strip is inserted through the hole and the legs engage over a portion of the uppermost end of the cardboard backing sheet. In this manner the product is attached to the clip strip or sheet. The attachment of the products onto the clip strip or sheet is a labor intensive operation inasmuch as every single product has to manually be mounted onto a peg on a clip strip. Once the products are mounted onto the clip strips or sheets, they are packaged and sent to the retailer. During transit, the products tend to become disengaged from the pegs. It is common for retailers to find that around 50% of the products have become detached from the clip sheets or strips during transit. It is then up to the retailer to utilize their employees to reinstall the products onto the strips. The clip strips or sheets are then hung onto the displays or shelf supports so that consumers can see them.

Apart from the disengagement of the products from previously known clip sheets and strips, these merchandising products have also had other disadvantages for the retailer. The first of these is that a fairly limited number of products may be displayed on any one clip strip or sheet. Secondly, when consumers remove the products from the clip strips, they may accidentally disengage other products from the strip. Thirdly, once a peg has been used, it tends to become slightly deformed and consequently if a consumer attempts to reattach products onto the clip strip, they tend to fall off again. After a few attempts the consumer is likely to give up and place the product on another shelf. This leaves the retailer with the problems of not having products adequately on display in the store and secondly of having to repeatedly reattach products onto the strips or sheets. Even if the products remain on the sheets the displays tend to be messy in appearance. This does not enhance the aesthetic appeal of the clip strip display and does not aid in selling the product.

The device of the present invention addresses some of the problems of the prior art.

The device of the present invention is a display card that includes a means for releasably securing a product to it. The means is preferably an adhesive applied to the sheet that allows products to be directly applied to the sheet, to be removed therefrom for inspection by the consumer and repositioned on the sheet with ease. The display card includes an adhesive applied to at least a portion of the surface area of the card. The adhesive is of such a type that it allows for repeated application and removal of the product from the card. Furthermore, the adhesive preferably has a pull strength in the range of 6 oz./sq. in. to 64 oz./sq. in.

A method of manufacturing the display card of the present invention is also provided. The method of manufacturing includes applying adhesive to at least a portion of the surface area of a sheet of suitable material, positioning the product to be displayed onto the card so that the product adheres to the adhesive and then boxing product-laden display cards for shipping to the retailer.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
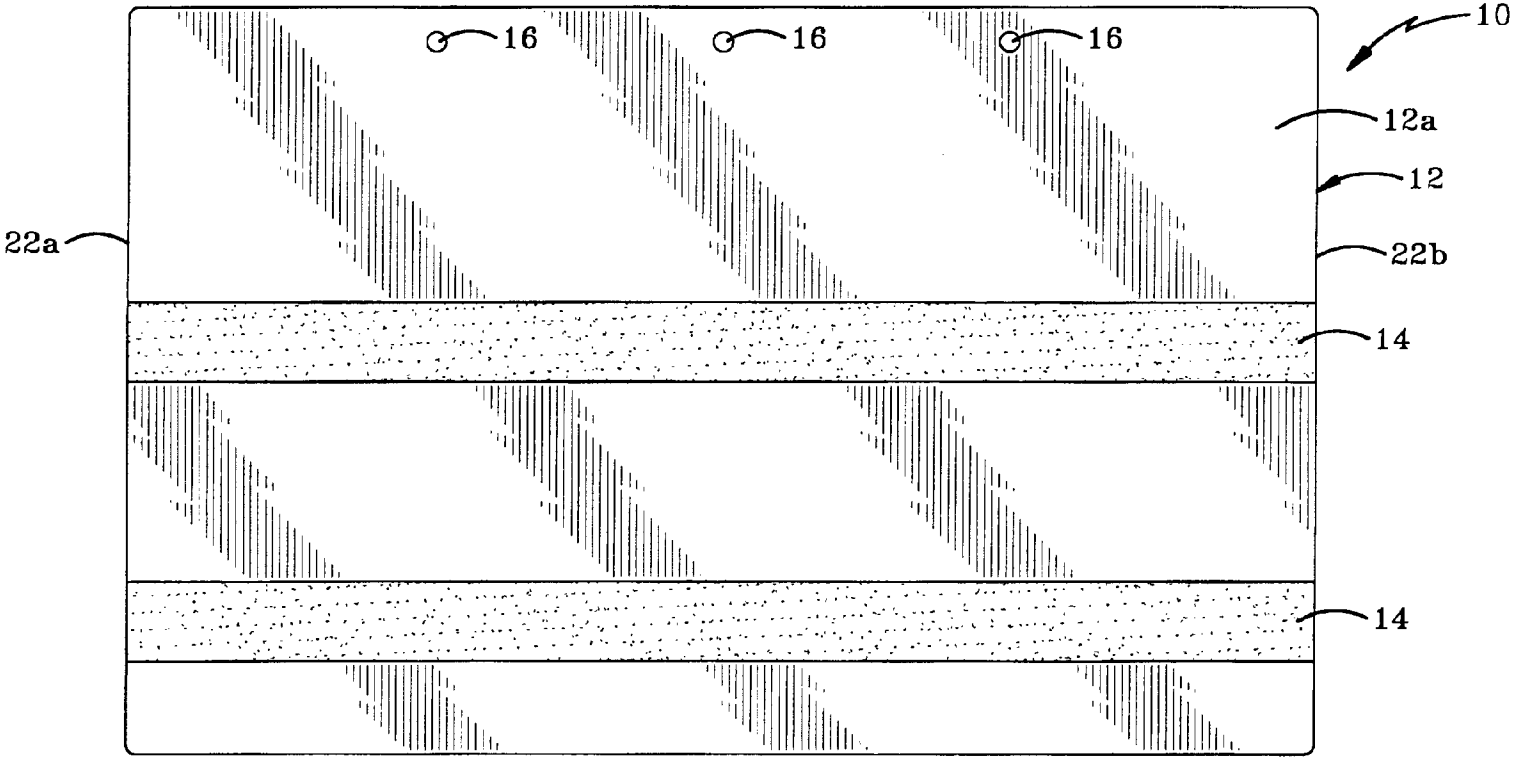
FIG. 1 is a front view of a first embodiment of a display card in accordance with the present invention.
Figure 2:
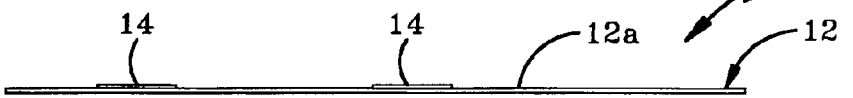
FIG. 2 is a side view of the display card of FIG. 1.
Figure 4:
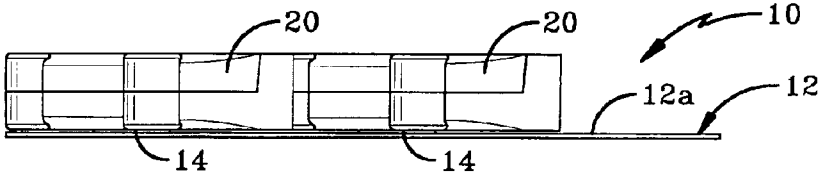
FIG. 4 is a side view of the display card shown in FIG. 3.

A first embodiment of the merchandising strip display card, generally represented by the number 10, is shown in FIGS. 1 through 6.

Display card 10 comprises a sheet 12 with a plurality of rows of adhesive strips 14 mounted thereon. Products 20 are detachably mounted onto strips 14. Card 10 defines a plurality of holes 16 by which it may be hung from hooks 18 on a display (not shown) in a retail store.

Sheet 12 may be manufactured from any suitable material such as plastic, paperboard or any other material of sufficient strength to hang on a display and support the weight of the products 20 to be carried thereon. For the purposes of illustration, the products 20 shown carried on display card 10 are packages of adhesive tape.

Adhesive strips 14 may be lengths of double-sided adhesive tape that are applied to card 10 during production. Alternatively, strips 14 may be glue that is extruded onto card 10 during production. The adhesive used is of a type that is suitable for repeatedly applying and removing products therefrom. A suitable type of adhesive would be acrylic or rubber based. While strips 14 are shown as extending from one edge 22*a* of card 10 to the opposite edge 22*b*, they may instead be applied at predetermined intervals across the width of card 10. Alternatively, the adhesive may be applied across the entire surface of sheet 12. Adhesive strips 14 may be manufactured from an adhesive tape or glue that preferably has a pull strength of between 6 oz./sq. in. and 64 oz./sq. in. The pull strength is sufficient to hold product 20 on sheet 12 when display card 10 is suspended from hooks 18 and is sufficient to prevent accidental removal of product 20 from sheet 12. The pull strength of the adhesive is not so strong that a consumer needs to apply an extraordinary force to intentionally remove product 20 from card 10.

Figure 3:
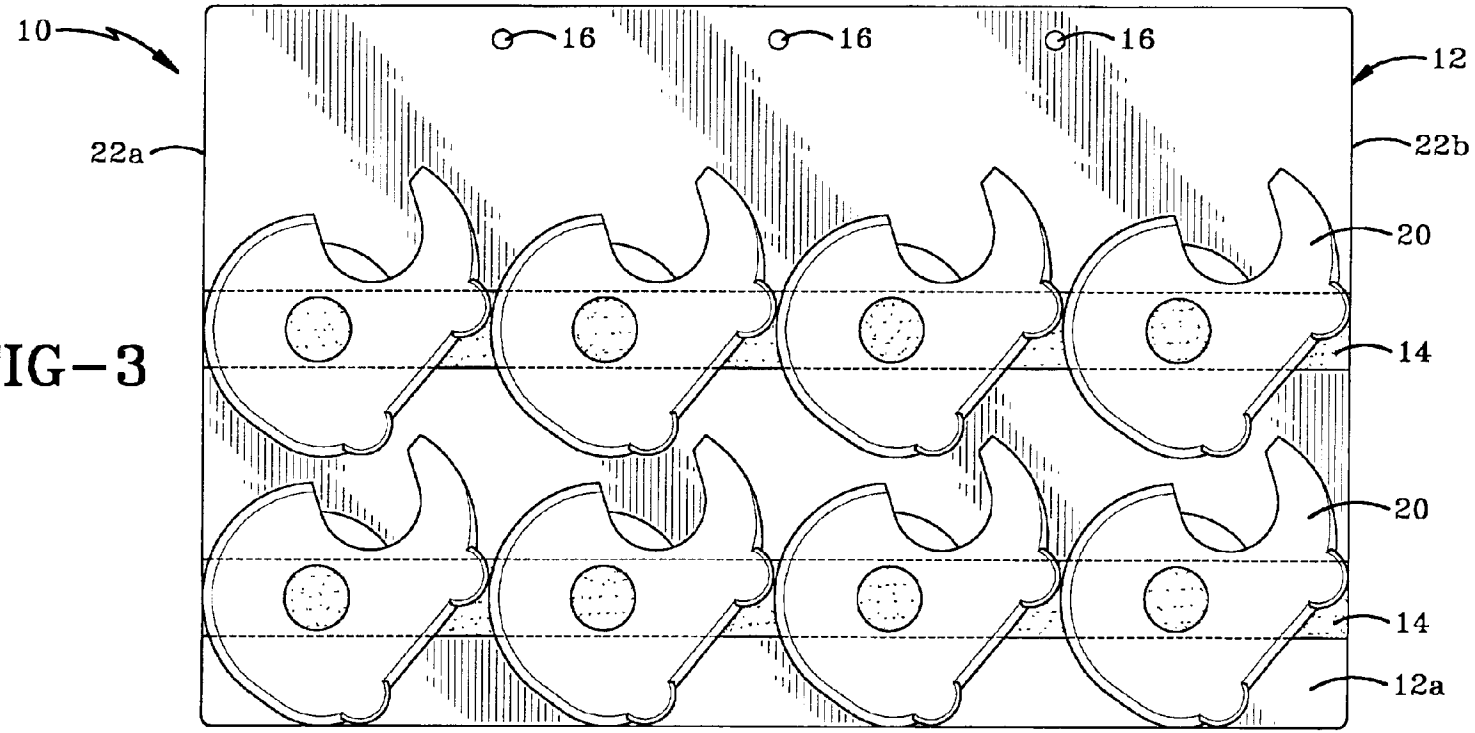
FIG. 3 is a front view of a display card of the present invention showing a number of products mounted thereon.
Figure 3A:
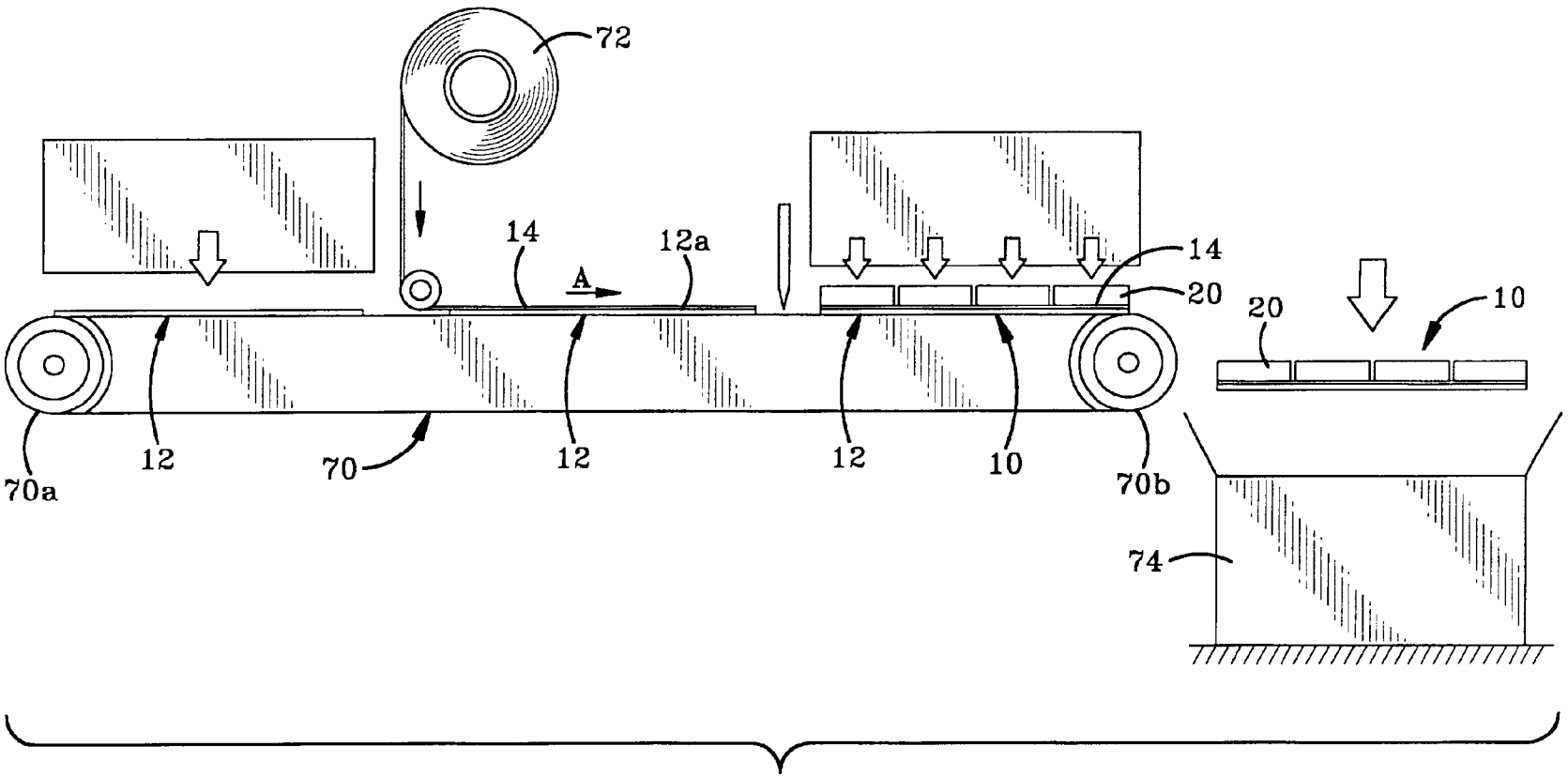
FIG. 3*a* is a side view of a production line for manufacturing the first embodiment of the display card of the present invention.
Figure 5:
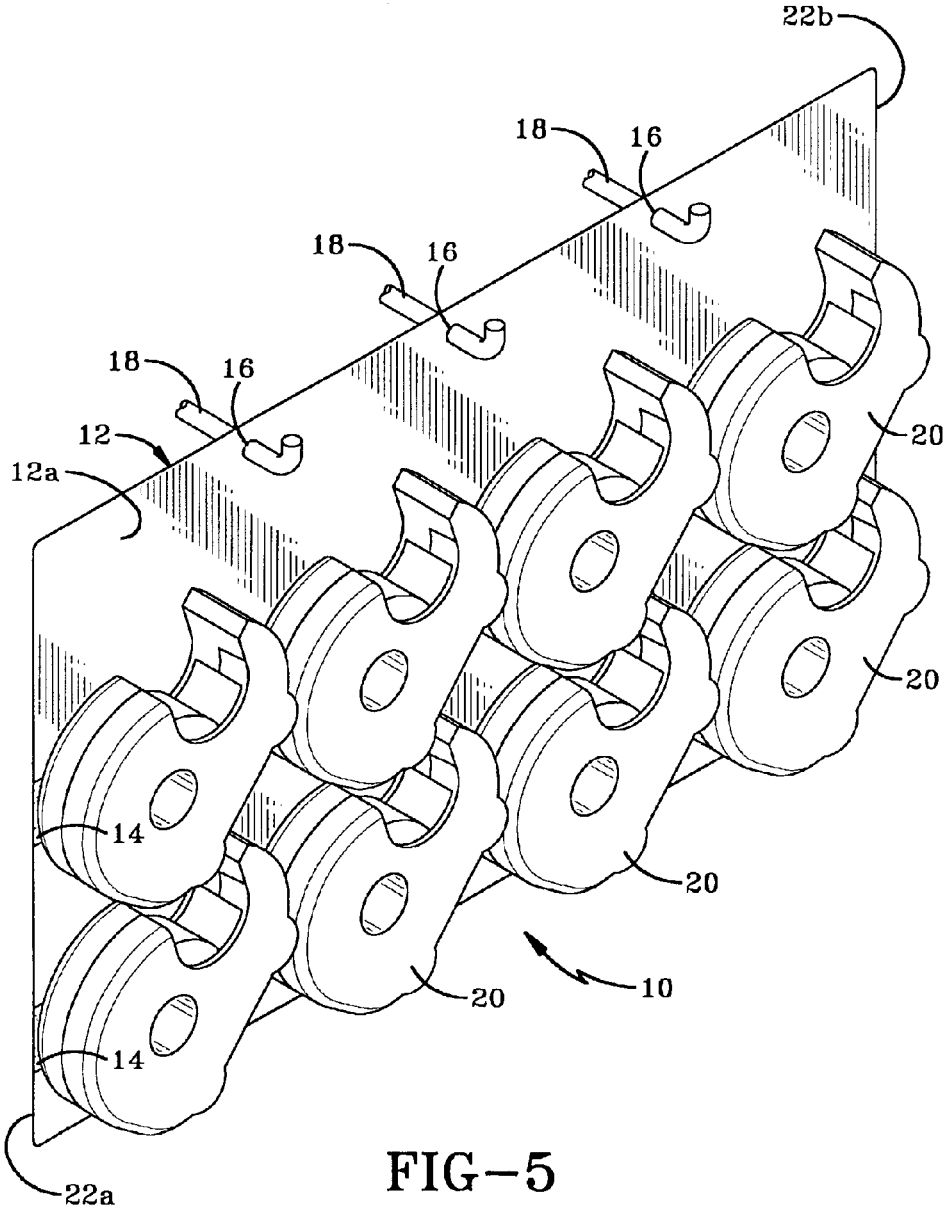
FIG. 5 is a perspective view of a display card of FIG. 3 showing the display card as it would be hung in a retail store for display to consumers.
Figure 6:
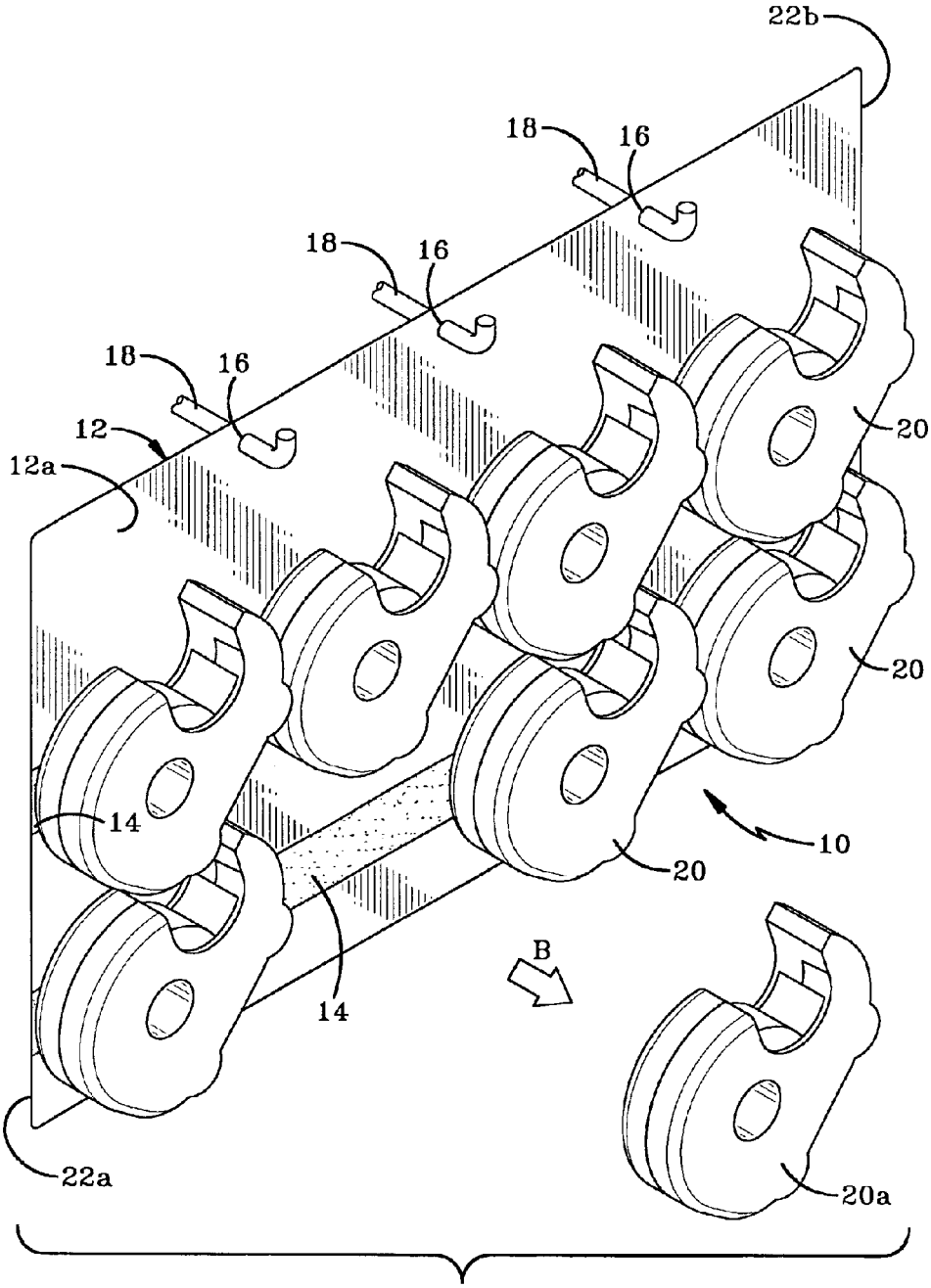
FIG. 6 is a perspective view of the display card of FIG. 5, showing a product being removed therefrom.
Figure 7:
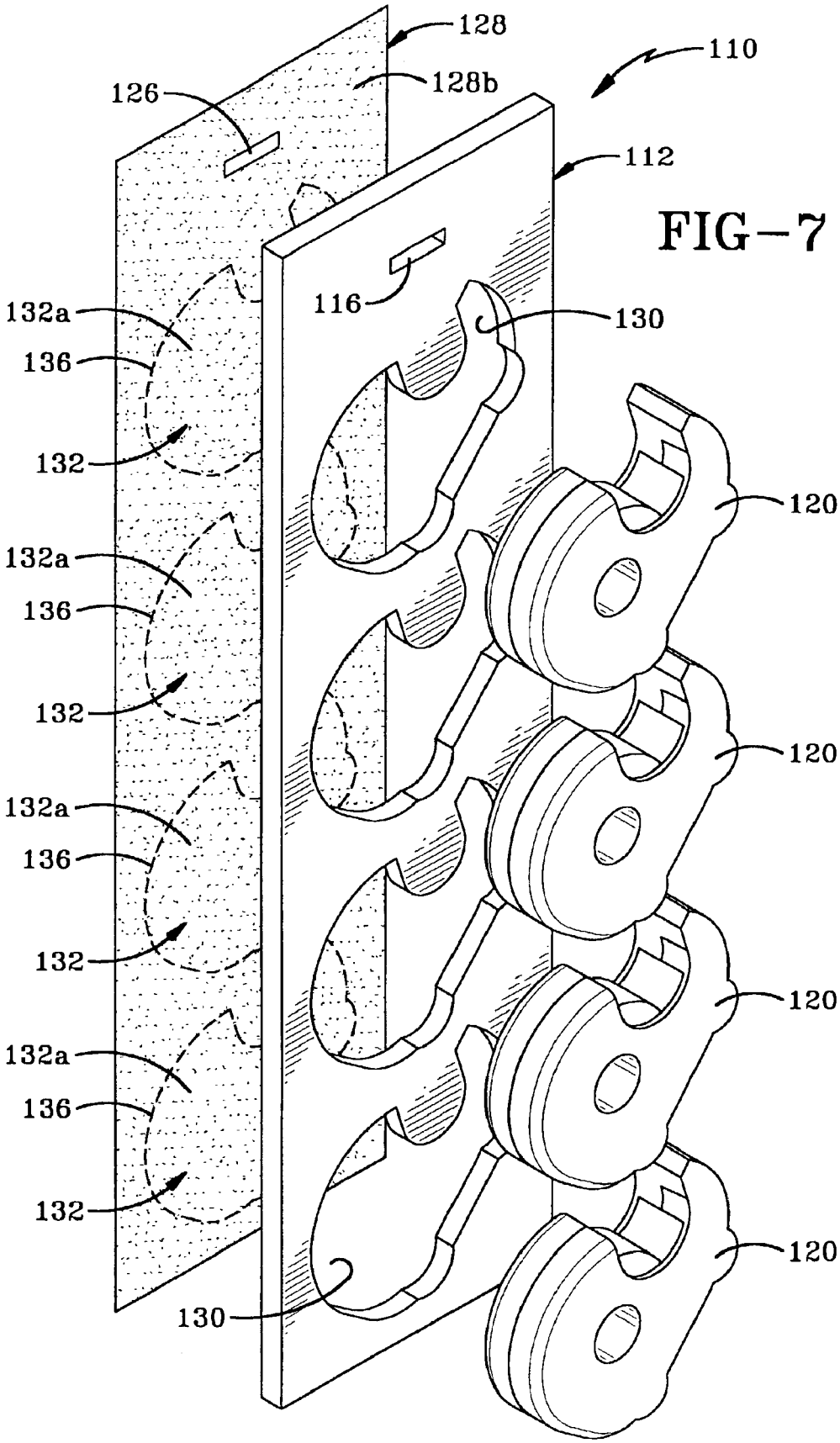
FIG. 7 is an exploded perspective front view of a second embodiment of a display card in accordance with the present invention.
Figure 8:
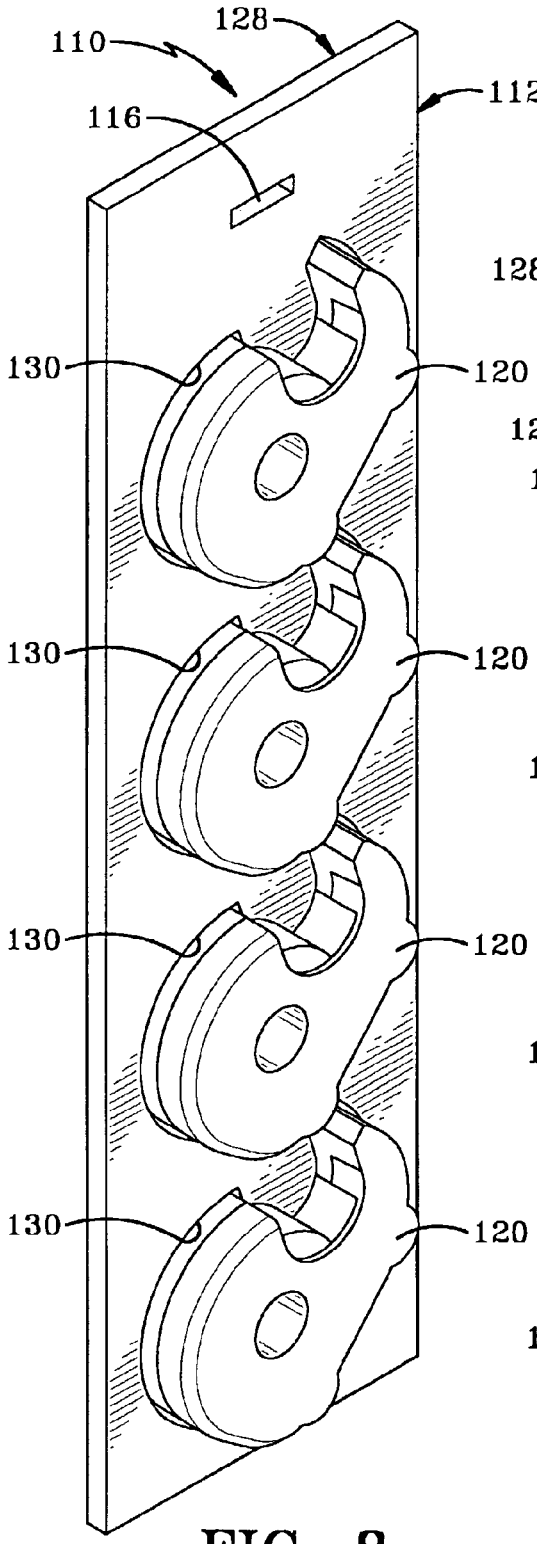
FIG. 8 is a perspective front view of the display card of FIG. 7 showing products mounted thereon.
Figure 9:
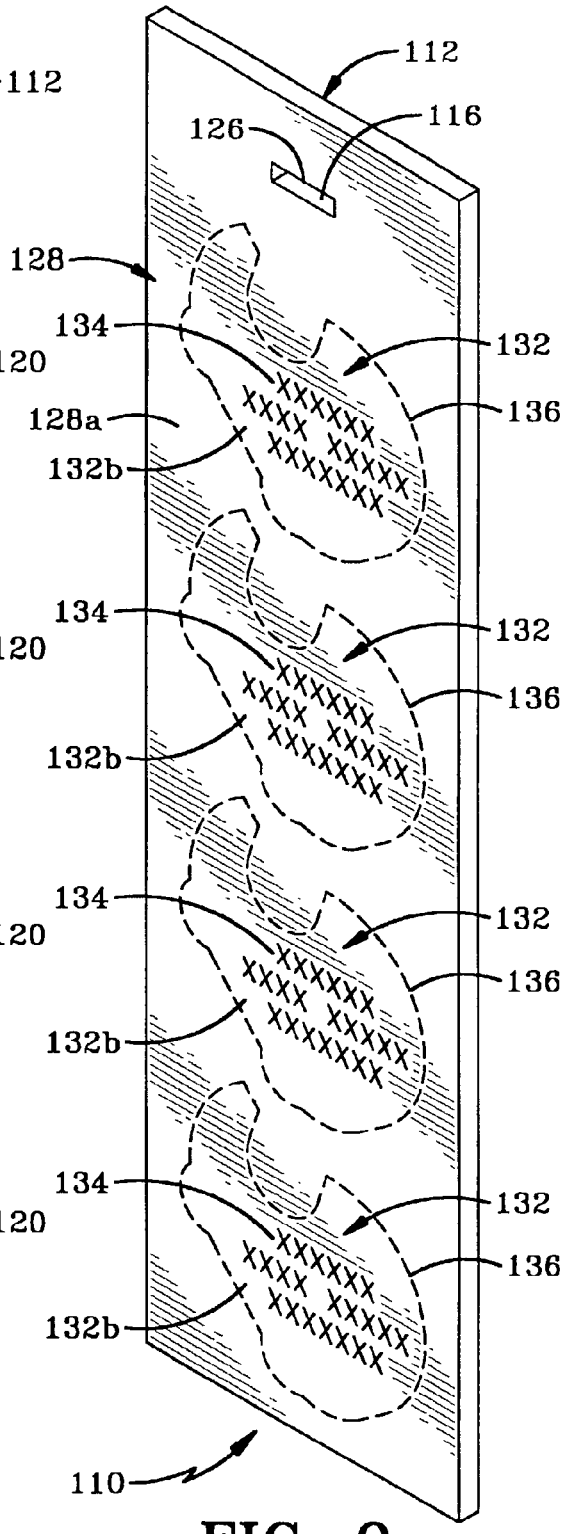
FIG. 9 is perspective rear view of the display card of FIG. 7.

Referring to FIG. 3*a*, there is shown a production line for producing display card 10. In this production line there are basically four stations. In the first station, sheet 12 is dropped from a chute onto the first end 70*a* of a conveyor belt 70. Conveyor belt 70 moves sheet 12 in the direction indicated by arrow A into the second station where adhesive strips 14 from a roll 72 of adhesive tape are applied to at least a portion of the surface 12*a* of sheet 12. As will be understood by those skilled in the art, if a type of adhesive other than adhesive strips or tape is to be applied to sheet 12, then the appropriate delivery mechanism will be placed in the second station. Conveyor belt 70 moves sheet 12 into the third station where products 20 are placed onto sheet 12 in such a manner that they become adhered to the adhesive strips 14. Conveyor 70 moves sheet 12 to the second end 70*b* into the fourth station where the completed display card 10 with product 20 attached is removed from conveyor 70 and is dropped into a box 74. The process is repeated until the box 74 is full and ready to be shipped. The conveyor belt 70 moves sheet 12 in the direction indicated by arrow A into the second station where adhesive strips 14 from a roll 72 of adhesive tape are applied to at least a portion of the surface 12*a* of sheet 12. Conveyor belt 70 moves sheet 12 into the third station where products 20 are placed onto sheet 12 in such a manner that they become adhered to the adhesive strips 14. Conveyor 70 moves sheet 12 to the second end 70*b* into the fourth station where the completed display card 10 with product 20 attached is removed from conveyor 70 and is dropped into a box 74. The process is repeated until the box 74 is full and ready to be shipped.

When a consumer wants to look at or purchase a product 20*a* attached to display card 10, they can pull on product 20*a* in the direction of arrow B (FIG. 6) and product 20*a* will detach from adhesive strip 14. If the consumer decides they do not wish to purchase product 20*a*, they can simply push product 20*a* back into contact with strip 14 and product 20*a* will become reattached to sheet 12.

A second embodiment of the display card of the present invention is shown in FIGS. 7 through 12. In this embodiment, a display card, generally indicated by the number 110, comprises a first sheet 128 and a second sheet 112 that are placed in abutting contact with each other and are bonded together by a suitable means such as adhesive, staples, rivets etc.

Second sheet 112 may be made from any suitable material such as plastic, corrugated plastic (Coreplast) or corrugated cardboard. Second sheet 112 is sufficiently thick and strong to hold products 120 therein. Second sheet 112 defines an hole 116 through which a hook (not shown) may be received for hanging card 110 for display in a retail store. Second sheet 112 further defines at least one aperture 130 that is configured to the shape of a product 120 that may be attached to display card 110 during manufacture. Aperture 130 may be cut into second sheet 112, may be stamped or molded into second sheet 112, or may be formed in any other suitable manner.

Figure 10:
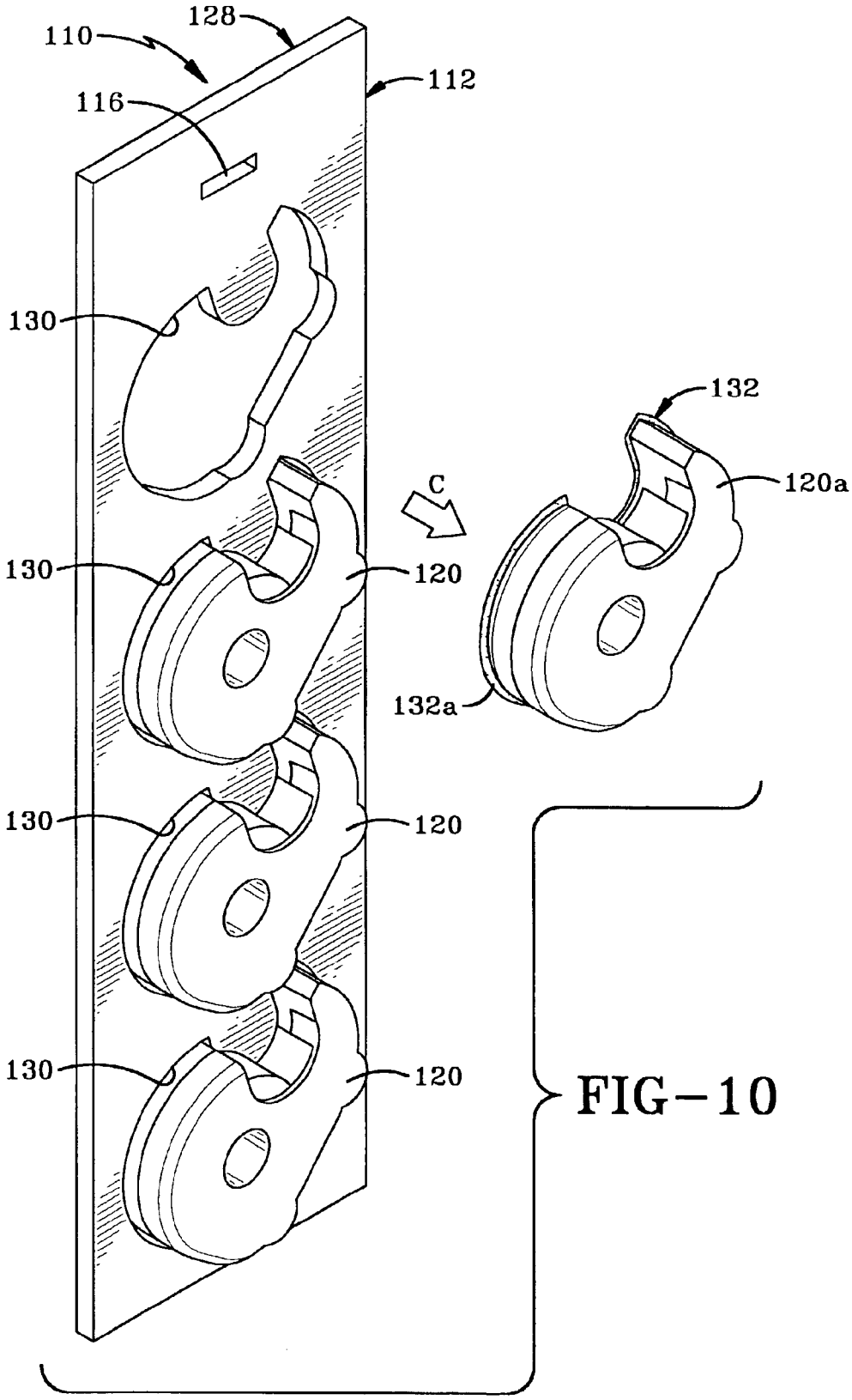
FIG. 10 is a perspective front view of the display card of FIG. 7, showing a product being removed therefrom.
Figure 11:
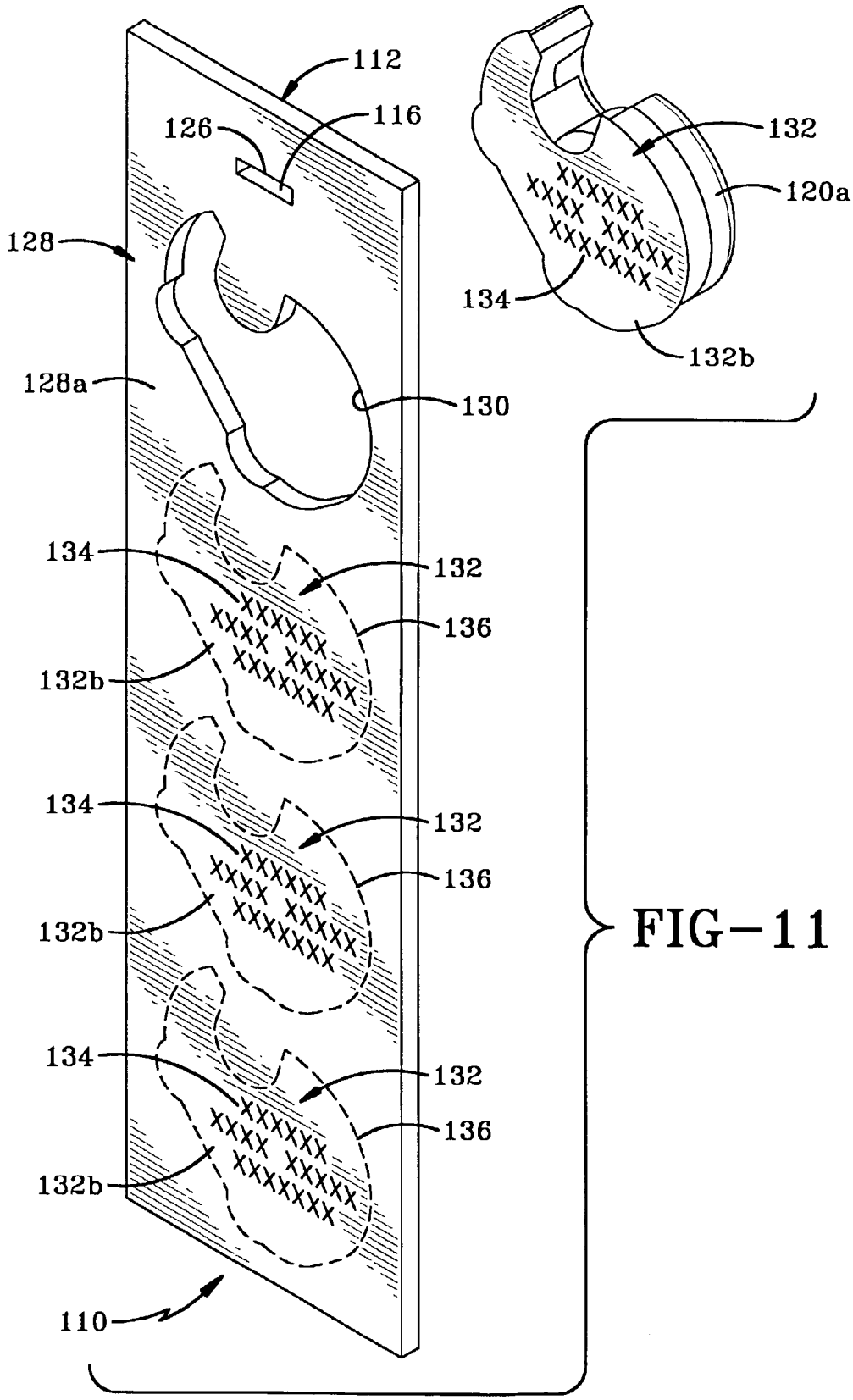
FIG. 11 is a perspective rear view of the display card of FIG. 7, showing a product being removed therefrom.

First sheet 128 may be made of any suitable material such as paper or cardboard. First sheet 128 defines a hole 126 therein that aligns with hole 116 when second sheet 112 is connected to first sheet 128. First sheet 128 forms at least one product-shaped region or backing area 132 to aperture 130 when second sheet 112 and first sheet 128 are joined together. The adhesive used to join second sheet 112 to first sheet 128 preferably covers the entire front surface of first sheet 128. The adhesive would therefore cover the entire front surface 132*a* of backing area 132 (FIG. 10). Alternatively, adhesive strips (not shown) or drops of glue (not shown) may be applied to only a portion of front surface 132*a* to attach a product 120 to display card 110. When a product 120 is inserted into aperture 130, it will be secured to front surface 132*a* by the adhesive. The adhesive will preferably have a pull strength of between 6 oz./sq. in. and 64 oz./sq. in. Products 120 may be inserted into apertures 130 during production and will be held in place by the adhesive on the front surfaces 132*a* of backing areas 132. When a consumer desires to purchase product 120, they simply pull on product 120 and it will releasably disengage from the adhesive. The adhesive may be of a type that allows for repeated removal and replacement of the product 120. If a consumer wishes to replace product 120, they simply reinsert it into aperture 130.

Alternatively, the adhesive may have a pull strength of between 6 oz./sq. in. and 64 oz./sq. in. This pull strength is sufficient to keep product 120 bonded to front surface 132*a*. The rear side 128*a* of first sheet 128 may include product information 134 printed within the perimeter 132*b* of backing area 132. Furthermore, backing area 132 may include perforations 136. When product 120 engages the adhesive, front surface 132*a* will be firmly bonded to product 120. When the consumer desires to examine or purchase a product 120*a*, they pull on product 120*a* in the direction of arrow C (FIG. 10). The strength of the adhesive bonding product 120*a* to front surface 132*a* of first sheet 128 is sufficient to prevent product 120*a* from being withdrawn from aperture 130*a* without causing perforations 136 to tear away from first sheet 128. Product 120*a* may then be withdrawn from aperture 130 and backing area 132 remains bonded to product 120*a*. Should the consumer decide not to purchase product 120*a*, they may reinsert product 120*a* into aperture 130*a*.

Figure 12:
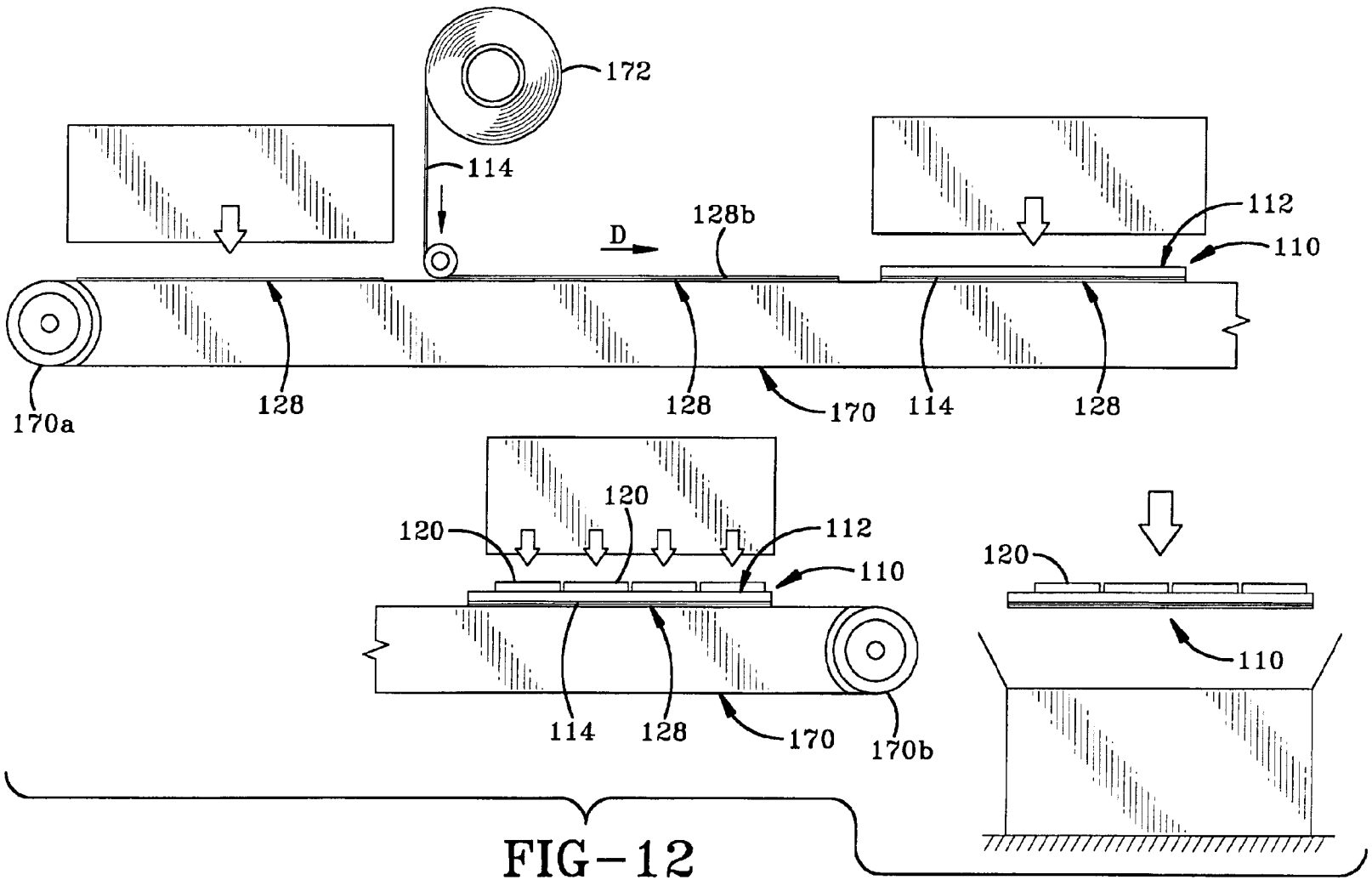
FIG. 12 is a side view of a production line for manufacturing the second embodiment of the display card of the present invention.

Referring to FIG. 12, there is shown an example of a possible production line for producing the second embodiment of display card 110. In this production line there are basically five stations. In the first station, first sheet 128 is placed onto the first end 170*a* of a conveyor belt 170. Conveyor belt 170 moves first sheet 128 in the direction indicated by arrow D into the second station where adhesive strips 114 or an adhesive sheet from a roll 172 of adhesive tape are applied to at least a portion of the surface 128*b* (FIG. 10) of sheet 128. Conveyor belt 170 then moves first sheet 128 into the third station where sheet 112 is brought into contact with adhesive strips 114 thereby bonding sheet 112 to first sheet 128. It will be understood by those skilled in the art that if a type of adhesive other than adhesive strips or tape is to be applied to first sheet 128, then the appropriate delivery mechanism would be placed in the second station. Alternatively, if the adhesive strips 114 are not used to bond first sheet 128 and second sheet 112 together, a separate adhesive dispensing mechanism would be provided in the production line. Furthermore, if the first sheet 128 and second sheet 112 are secured to each other in some other way, that mechanism would have to be included in the production line.

Conveyor belt 170 moves display card 110 into the fourth station where products 120 are placed into product-shaped apertures 130 (FIG. 10) in sheet 112 so that they adhere to adhesive strips 114. Conveyor 170 moves display card 110 to the second end 170*b* of the conveyor and into the fifth station where the completed display card 110 with product 120 attached is removed from conveyor 170 and is dropped into a box 174. The process is repeated until the box 174 is full and ready to be shipped.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A display card for merchandising products, the card being adapted to be hung on a support to display a product, the display card comprising:

a) a first sheet;

b) a second sheet that lies in abutting contact with the first sheet and is secured thereto; the second sheet defining at least one aperture that is adapted to receive the product therein; and in which the aperture has a perimeter complementary sized and shaped to the outermost perimeter of the product; and in which the first sheet forms a backing area to the aperture and the backing area has a front surface adapted to contact the product; and when the product is received in the aperture the product's outermost perimeter abuts the perimeter of the aperture; and c) an adhesive applied to at least a portion of the front surface of the backing area; the adhesive being adapted to releasably attach the product thereto.

2. The display card as defined in claim 1, wherein the adhesive is applied over the entire front surface of the backing area.

3. The display card as defined in claim 1, wherein the adhesive is applied in distinct bands across the front surface of the backing area.

4. The display card as defined in claim 3, wherein the adhesive is a two-sided tape.

5. The display card as defined in claim 1, wherein the adhesive has a pull strength of between 6 oz./sq.in. and 64 oz/sq.in.

6. The display card as defined in claim 1, wherein the adhesive allows for repeated removal and replacement of the product thereon.

7. The display card as defined in claim 1, wherein the backing area has a perimeter aligned with the perimeter of the aperture and the backing area perimeter includes a plurality of perforations that allow the backing area to be torn away from the first sheet.

8. The display card as defined in claim 7, wherein the adhesive has a pull strength of between 6 oz./sq.in. and 64 oz./sq.in and the adhesive is adapted to bond to a product with sufficient strength to cause the perforations to tear when a product is withdrawn from the aperture.

9. The display card as defined in claim 7, wherein the backing area has a rear surface and the rear surface is adapted to include product information.

10. The display card as defined in claim 1, wherein the first sheet is selected from the group consisting of paperboard, corrugated paperboard, corrugated plastic or plastic.

11. The display card as defined in claim 1, wherein the second sheet is manufactured from a relatively rigid material.

12. A method of producing a display card for merchandising products, the card being adapted to be hung on a support and to display a product, and the display card including a first sheet having a front surface with adhesive applied to at least a portion thereof, the adhesive being adapted to releasably attach a product thereto, the method comprising the steps of:

a) applying adhesive to at least a portion of the front surface of the first sheet;

b) placing a product into bonding contact with the adhesive on the first sheet;

(c) forming a product-shaped aperture in a second sheet;

(d) bonding the second sheet to the front surface of the first sheet;

(e) inserting a product into the product-shaped aperture in the second sheet.

13. A method of producing a display card as defined in claim 12, further comprising the steps of:

a) perforating an area in the first sheet that is adapted to lay adjacent the perimeter of the aperture in the second sheet.

14. In combination:

a display card comprising first and second sheets that are secured together, with the second sheet including an aperture having a perimeter; and in which the first sheet forms a backing surface for the aperture and that backing surface includes an adhesive thereon;

a product for display on the display card, wherein the product has an outermost perimeter complementary in size and shape to the aperture on the display card;

wherein the product is inserted into the display card so that the product's outermost perimeter abuts the perimeter of the aperture.

15. The combination of claim 14, wherein the product is an adhesive tape dispenser.

16. The combination of claim 15, wherein the second sheet is selected from the group consisting of paperboard, corrugated paperboard, plastic and corrugated plastic.

17. The combination of claim 16, wherein the adhesive is applied over a portion of the backing sheet.

18. The combination of claim 16, wherein the adhesive is applied over all of the backing sheet.

19. The combination of claim 15, wherein the backing sheet includes a plurality of perforations aligned with the perimeter of the aperture.

20. The combination of claim 19, wherein the backing sheet includes an outer surface upon which product information is displayed.

* * * * *